US009518413B2

(12) United States Patent
Aykas

(10) Patent No.: US 9,518,413 B2
(45) Date of Patent: Dec. 13, 2016

(54) CORNER FITTING FOR DISPOSING A DOOR ELEMENT ON A CENTER OF ROTATION OR AN AXIS

(71) Applicant: DORMA Deutschland GmbH, Ennepetal (DE)

(72) Inventor: Kenan Aykas, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/945,059

(22) Filed: Nov. 18, 2015

(65) Prior Publication Data

US 2016/0160546 A1 Jun. 9, 2016

(30) Foreign Application Priority Data

Dec. 4, 2014 (EP) ..... 14196228

(51) Int. Cl.

| | |
|---|---|
| ***E05D 7/04*** | (2006.01) |
| ***E05D 5/02*** | (2006.01) |
| ***E05D 7/081*** | (2006.01) |
| ***E05D 15/00*** | (2006.01) |
| ***E06B 3/02*** | (2006.01) |
| ***E06B 3/36*** | (2006.01) |
| ***E06B 3/88*** | (2006.01) |
| *E05D 15/54* | (2006.01) |

(52) U.S. Cl.

CPC ..... *E05D 7/04* (2013.01); *E05D 5/0246* (2013.01); *E05D 7/081* (2013.01); *E05D 15/00* (2013.01); *E06B 3/02* (2013.01); *E06B 3/36* (2013.01); *E06B 3/88* (2013.01); *E05D 15/54* (2013.01); *E05D 2007/0461* (2013.01); *E05D 2007/0484* (2013.01); *E05D 2700/00* (2013.01); *E05Y 2600/12* (2013.01); *E05Y 2600/502* (2013.01); *E05Y 2800/672* (2013.01); *E05Y 2900/132* (2013.01)

(58) Field of Classification Search

CPC ..... E05D 7/04; E05D 15/00; E05D 2700/00; E06B 3/88; E06B 3/02; E06B 3/36

USPC ..... 49/388; 16/378, 252, 382

See application file for complete search history.

(56) References Cited

U.S. PATENT DOCUMENTS

| | | | |
|---|---|---|---|
| 4,785,499 A | 11/1988 | Giuffrida et al. | |
| 5,203,115 A | 4/1993 | Marinoni | |
| 6,519,811 B1 * | 2/2003 | Cheng | 16/252 |

(Continued)

FOREIGN PATENT DOCUMENTS

| | | |
|---|---|---|
| DE | 8536840 U1 | 2/1990 |
| DE | 102009022802 A1 | 12/2010 |

*Primary Examiner* — Jerry Redman

(74) *Attorney, Agent, or Firm* — Cantor Colburn LLP

(57) ABSTRACT

A corner fitting for disposing a door element on a center of rotation or an axis includes first and second fitting elements-, which, at least sectionwise, each include a locating portion for the abutment against the door element and are interconnectable while restraining the door element. A restraining area forms between the two fitting elements, into which the door element is insertable, and the fitting elements are formed such that a holding element is disposed between the two fitting elements. The holding element is displaceable in relation to the fitting elements and is at least partially rotatable about the center of rotation or the axis. The holding element is in operative connection with a connecting element, which serves for supporting the door element on the center of rotation or the axis.

16 Claims, 4 Drawing Sheets

(56) References Cited

U.S. PATENT DOCUMENTS

| | | | | |
|---|---|---|---|---|
| 6,643,898 | B1 * | 11/2003 | Cameron et al. | 16/382 |
| 6,826,870 | B2 * | 12/2004 | Chiang | 49/388 |
| 6,925,685 | B2 * | 8/2005 | Chen | 16/332 |
| 7,107,723 | B2 * | 9/2006 | Chiang | 49/388 |
| 7,673,373 | B2 * | 3/2010 | Chang et al. | 16/250 |
| 8,578,557 | B2 * | 11/2013 | Yu | 16/55 |
| 8,720,005 | B2 * | 5/2014 | Cheng | 16/54 |
| 8,745,822 | B2 * | 6/2014 | Garrett | 16/252 |
| 2004/0206007 | A1 * | 10/2004 | Chiang | 49/388 |
| 2006/0207060 | A1 * | 9/2006 | Cheng | 16/252 |
| 2008/0168621 | A1 * | 7/2008 | Lin | 16/252 |
| 2009/0188082 | A1 * | 7/2009 | Huang | 16/382 |

* cited by examiner

CORNER FITTING FOR DISPOSING A DOOR ELEMENT ON A CENTER OF ROTATION OR AN AXIS

TECHNICAL FIELD

The present disclosure relates to a corner fitting for a door element to be disposed on a center of rotation and/or an axis, as well as to a method for disposing a door element on a center of rotation and/or an axis by means of a corner fitting.

BACKGROUND

Conventional corner fittings allow for disposing door elements, for example glass doors on standardized centers of rotation or an axis. The glass doors are for example double-action glass doors or sliding glass doors, which are disposed by means of conventional corner fittings for example on a BTS-axis. The fitting devices forming this species comprise mostly two fitting elements, which each include one locating portion for the door element, wherein the door element is clamped between the locating portions in a restraining area, respectively clamping area. With the intention to create a free space for disposing the door element on the center of rotation or the axis, the door element is cut out in a corner area, in which the corner fitting is clamped. In this case, the cutout of the contour of the door element is chosen such that the locating portions of the fitting elements reach abutment against the door element along the cutout contour. Outside the locating portions, namely outside the clamping area, a free space is created between the fitting elements, which is utilized for disposing the door element on a standardized center of rotation or an axis. In the prior art corner fittings, a connecting element, which is either configured to be integral, i.e. with one or with both of the fitting elements, or which is selectively provided as individual structural component between the fitting elements, is known for disposing the door element on the standardized center of rotation or the axis. In the prior art corner fittings, the only adjustment option provided is to dispose the connecting element in such a way within the corner fitting that a door element clamped in the corner fitting can be adjusted to the standardized center of rotation or to axes having a measure of 55 mm, 65 mm or 70 mm. In addition to said limited adjustment option of the prior art corner fittings, the prior art corner fittings are not suited either for aligning a door element about the center of rotation or the axis. Hence, if a door element, which is disposed on the center of rotation or the axis, is not aligned flush for example along the longitudinal edge of a door casing or at a glass element of an all-glass door installation, a flush alignment with the prior art corner fittings at the door casing or the adjoining glass element is not possible.

Therefore, the present disclosure provides an apparatus for overcoming the above-described disadvantages of the state-of-the-art at least partially. The present disclosure provides a corner fitting offering an adjusting option for a door element on a center of rotation and/or an axis, namely the adjustment of the door element about the center of rotation or the axis.

DISCLOSURE

SUMMARY

Features and details, described in conjunction with the corner fitting are obviously also valid in conjunction with the method, and respectively vice versa, such that mutual reference is made, respectively can be made with respect to the disclosure of individual aspects of the disclosure.

The inventive corner fitting for a door element to be disposed on a center of rotation and/or an axis, including a first fitting element and a second fitting element, wherein each includes at least sectionwise a locating portion for the abutment against the door element and are connectable to each other while restraining the door element, includes the technical teaching that a restraining area is formed between the two fitting elements into which the door element can be inserted, and that the fitting elements are configured such that a holding element, which is displaceable in relation to the fitting elements and is at least partially rotatably about the center of rotation and/or the axis, is disposed between the two fitting elements, wherein said holding element is in operative connection with a connecting element, which serves for supporting the door element on the center of rotation and/or the axis.

Said solution offers the advantage that the holding element, which is displaceable in relation to the fitting elements and advantageously also serves for the infinitely variable selection for different centers of rotation, is in addition rotatable about the center of rotation and/or the axis together with the operatively connected connecting element, after the door element has been disposed, respectively adjusted on the center of rotation and/or the axis while maintaining the adjustment. Thereby, by means of the holding element, which is rotatable about the center of rotation and/or the axis, the door element as well can be aligned about the center of rotation and/or the axis. The at least sectionwise free rotatability of the holding elements within the fitting elements of the corner fitting allows for the holding element to act in different positions in the most diverse variations upon the fitting elements. In case one corner of a door element is located for example too close at the longitudinal casing of a door frame or at an adjoining glass door element of an all-glass door installation, and if the other one, which usually should adjoin the other longitudinal side of the frame, lifts-off the longitudinal casing, by rotating the holding element, the holding element can be brought to abut against the fitting elements such that the door element restrained in the corner fitting is aligned flush from the door to the adjoining glass door element (sidepanel) or from the door and center joint or at the casing.

In an advantageous manner, the holding element and the connecting element, which serves for supporting the door element on the center of rotation and/or the axis and is in operative connection with the holding element, are two structural components of the corner fitting, which are connected to each other. Said structural components preferably form an attaching mechanism, which is incorporated at the holding element and at the connecting element in advantageous manner and which is transferable between a released condition and a fixing condition. In the released condition of the attaching mechanism, the holding element is supported at the fitting elements to be displaceable. In contrast thereto in the fixing condition of the attaching mechanism, the holding element is at least non-positively and/or positively connected at least at one fitting element. Accordingly, on the one hand, the attaching mechanism formed at the holding element and at the connecting element serves for adjusting the corner fitting on a center of rotation and/or an axis, i.e. for displacing, respectively for rotating about the center of rotation and/or the axis the holding element and the connecting element connected to the holding element in particular in relation to the fitting elements, and in particular in relation to the longitudinal extension of the fitting elements.

Moreover, the attaching mechanism serves for fixing the corner fitting in the adjusted position, namely for fixing the holding element via the attaching mechanism at least at one of the fitting elements at least non-positively and/or positively.

For establishing an operative connection between the holding element and the connecting element, i.e. for forming the attaching mechanism, the holding element and the connecting element are particularly and advantageously non-positively and/or positively connected to each other via at least one attachment element. The attaching element may be for example a screw, such as e.g. a headless screw, which connects the holding element and the connecting element to each other. Particularly advantageously, at least two attaching elements are provided, which connect the holding element to the connecting element. The non-positive and/or positive connection between the holding element and the connecting element, i.e. the transfer of the attaching mechanism from the released condition into the fixing condition, serves in addition in an advantageous manner for immobilizing the holding element at the attaching element, wherein in particular a head part of the holding element in a clamping way acts in the free space of the fitting element configured as a recess. In an advantageous way the clamping of the holding element via the head part acts upon both fitting elements, wherein advantageously the clamping force acting during the clamping is equally distributed on both fitting elements.

In an advantageous manner, the at least one fitting element and in a preferred manner both fitting elements include a free space as a guide, in which the holding element is movable. According to the idea of the application, for example a recess, a slot or a groove is understood as a free space, which extends in longitudinal extension of the fitting elements, at least in one of the fitting elements. According to the idea of the present disclosure, the distance created between the two fitting elements is also understood as a free space, which distance allows for moving the holding element, which advantageously includes a head part and a connecting part, with the connecting part in the free space between the fitting elements. In contrast thereto, the free space configured by the recess, the slot or the groove, which extends in longitudinal extension of the fitting elements, serves for supporting the holding element with its head part to be movable, respectively for attaching the holding element via the head part non-positively and/or positively to at least one fitting element.

In advantageous manner, the free space configured as a recess, groove or slot, is provided in both fitting elements. The recess, the groove or the slot extends in this case in advantageous manner in longitudinal extension of both fitting elements and extends in the two fitting elements preferably at the same height and parallel to each other. The free space in the fitting elements, referred to as recess, groove or slot, advantageously serves for guiding the holding element essentially parallel to the fitting elements and in relation to the longitudinal extension thereof. Advantageously, for this purpose the holding element includes the head part, which serves for supporting the holding element, at least in the released condition of the attaching mechanism, to be movable in the free spaces of both fitting elements. Based on this configuration, in the fixing condition of the attaching mechanism, clamping of the holding element via the head part is effective at both fitting elements, namely respectively in the recesses of both fitting elements, whereby the clamping force acting during clamping is advantageously distributed equally on both fitting elements.

In a preferred way, advantageously the free space is and/or the fitting elements are formed in this case in such a manner with regard to the holding element that a movement of the holding element along the longitudinal extension of the fitting element can be realized for up to 35 mm. Said configuration of the corner fitting allows for guaranteeing that an adjustment on centers of rotation and/or axes having a measure in the range from approximately 45 mm to approximately 80 mm is possible.

In addition to the free space configured as a groove, as a slot or as a recess in longitudinal extension of the fitting elements in at least one of the fitting elements, preferably a free space in the shape of a distance is formed between the fitting elements, which allows for guiding the holding element between the fitting elements at least in relation to the longitudinal extension thereof, wherein the connecting part of the holding element extends through the distance. In this case, in a preferred manner, the free space formed as a distance between the fitting elements is configured to be larger than the material thickness of the connecting part. In a preferred manner, the distance ranges between 1% to 100% larger than the material thickness of the connecting part, wherein in a preferred manner, in particular based on a compact construction type of the inventive corner fitting, the distance is equal to or larger than 10% with regard to the material thickness of the connecting part.

In a preferred manner, the free space formed as the distance between the fitting elements and the free space configured in longitudinal extension in the fitting elements is formed in such a way with regard to the holding element that the holding element is movable orthogonally with regard to the first direction of movement in longitudinal extension of the fitting elements in a second direction of movement between the fitting elements. Preferably, the free space, respectively the free spaces are formed in this case in such a way with regard to the holding element that a rotation of the holding element can be performed in relation the fitting elements and/or about the center of rotation and/or the axis of −2 degrees to +2 degrees. On the one hand, in particular the relation between the material thickness of the connecting part of the holding element towards the free space formed as a distance between the fitting elements is just delimiting for the degree of the rotation, and on the other hand, it is the surface of the head part of the holding element, which reaches support on the surface of the free space, when screwing out the head part, respectively screwing it into the surface of the free space configured as a recess in longitudinal extension of the fitting elements in the fixing condition of the attaching mechanism. It can be seen that the rotation of the holding element is delimited by the guided surface in the free space of the fitting elements, which free space is configured as a recess, and by the free space formed as a distance between the fitting elements. Correspondingly, by modifying said parameters, also the efficiency, i.e. the degree of freedom for the adjustment of the door element about the center of rotation and/or about the axis can be increased or, if required reduced.

For assisting the compact construction type of the inventive fitting, the head part and the free space formed as a groove, as a slot or as a recess of the fitting elements are configured such that the head part rests with a surface of less than 10 $cm^2$ on a surface of the free space configured as a recess. The head part configured in an L-shape of the holding element rests in particular with a surface of less than 5 $cm^2$ on a surface of the recess. Despite the small resting surfaces, the inventive corner fitting is able to support a relatively heavy door element, for example a glass door element having a width of 22 mm, on a center of rotation and/or an axis, without loosing the clamping effect between the holding element and the attaching elements in the fixing condition.

In advantageous manner, the restraining area is formed such that a thickness of the door element of up to approximately 22 mm can be accommodated. With the intention to be able to hold a door element, which is for example a glass door element having a very important weight, in the inventive corner fitting, and to be able to continue to guarantee the function of displaceability and in particular the one of rotatability, the fitting elements, the holding element as well as the connecting element are adapted to each other geometrically and/or material-technically such that a movement of the holding element can be performed of up to approximately 15 mm in relation to the fitting elements in the second direction of movement.

Preferably, the holding element is configured as an L-profile with a head part and a connecting part, preferably in the shape of two surfaces essentially directed orthogonally to each other, wherein the head part is supported in the free space configured as a groove, as a slot or as a recess in one of the fitting elements to be movable in the released condition of the attaching mechanism, and, in the fixing condition of the attaching mechanism, acts in a clamping manner in the recess. In the event both respective fitting elements have a free space configured as a groove, as a slot or as a recess, the head part of the holding element, respectively the holding element is advantageously configured as a T-profile for supporting the holding element to be movable in both recesses of the fitting elements, respectively for clamping it. By transferring the attaching mechanism from its released condition into the fixing condition, the holding element configured as a T-profile offers at least sectionwise a resting surface on both sides, i.e. in both free spaces configured as a groove, as a slot or as a recess of the fitting elements, which surface serves for the non-positive and/or positive connection between the holding element and the fitting elements, i.e. in the fixing condition of the attaching mechanism, the head part acts in a clamping manner between the two grooves, slots or recesses. In contrast to the holding element configured as an L-profile, the holding element configured as a T-profile clamps equally on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. In addition, the head part configured as a T-profile has the advantage that during a rotation of the holding element the surface rotated out of the free space of one of the fitting elements is rotated into the free space of the other fitting element. As already described for the holding element configured as an L-profile, in the holding element configured as a T-profile as well, the connecting element is connected to the holding element advantageously via a connecting part.

Advantageously, the connecting part and the head part of the holding element are configured as a common, monolithic and/or integral structural component. In this case, for example a structural component manufactured in an injection molding process from one or more different components is understood as a monolithic structural component. However, a structural component manufactured from a material, which for example is milled from a metal block by machining a metal block, can be understood as an integral structural component. Preferably, a common structural component is understood in that the head part and the connecting part are configured as individual parts, which are provided as a common structural component, namely as the holding element in a pre-mounted condition.

With the intention to assist the movement of the holding element in longitudinal extension of the fitting elements, which holding element is connected to the connecting element via the connecting part, a lower recess is formed at the fitting elements, which is preferably formed parallel to the recess configured as the free space and extends preferably over the same length as the recess configured as the free space. In this case, the lower recess is preferably formed in both fitting elements and extends over the distance of the fitting elements from the one to the other fitting element. Advantageously, the lower recess serves for displacing the connecting element together with the holding element at least sectionwise in longitudinal extension of the fitting elements. For guaranteeing a displacement of the connecting element over the entire length of the lower recess, the contour of the lower recess is adapted to the exterior contour of the connecting element. In case the exterior contour of the connecting element presents for example rounded corners, the contour of the recess has rounded corners as well, which correspond to the shape and the radius of the rounded corners of the exterior contour of the connecting element. In addition and advantageously, the rounded corners of the contour of the recess serve for preventing jamming of the connecting element in the border areas of the lower recess.

Accordingly, a holding element rotatable about the center of rotation and/or the axis should not only be understood as a rotatable holding element but also as a holding element displaceable vertically to the center of rotation and/or the axis. It is for example conceivable that an alignment on the center of rotation and/or the axis with different glass thicknesses is necessary by means of displacing the holding element within the fitting elements in two directions, namely away from the center of rotation or the axis or towards the center of rotation and/or the axis. In this way, the inventive corner fitting also serves for compensating for tolerances required for different glass thicknesses, when disposing the door element on the center of rotation and/or the axis. Moreover, via the holding element also a plane offset of the center of rotation, respectively the axis might be compensated for, i.e. that a glass element rotatably supported by means of the inventive corner fitting on the center of rotation and/or the axis can be aligned flush for example from the door to a sidepanel or from the door to the center joint.

The adjustment and in particular the rotation of the holding element about the center of rotation and/or the axis is advantageously realized via at least two adjusting elements. In this case, the adjusting elements are preferably disposed at the corner fitting such that they act upon a front and a back area of the holding element. In case for example the holding element is to be rotated counter-clockwise, the front and the back adjusting elements can be loosened, the holding element can be rotated and then the front and the back adjusting elements can be tightened again. Thus, by means of the adjusting elements, the spacing of connecting element of the holding element to the fitting elements is modified, respectively brought out of a parallel position to the fitting elements into an oblique position. In case, like in the above example, the holding element is rotated counter-clockwise, the front part of the connecting element, which is in operative connection with the connecting element, is pressed against the front fitting element. As the rotation of the holding element is realized via the center of rotation and/or the axis, the back part of the connecting element, which is likewise in operative connection with the connecting element, is pressed against the back fitting element in the same way. As both fitting elements together form a restraining area, into which the door element is insertable, also the door element restrained in the restraining area is rotated with the rotation of the holding element in relation to the center of rotation and/or the axis.

In advantageous manner, the holding element and the connecting element are individual components of the corner fitting. This is way for example different connecting elements, which serve for disposing the door element on different centers of rotation and/or the axes, can be connected to the holding element.

As already described, the connecting element and the holding element are connected via attaching elements and form the attaching mechanism, wherein in advantageous manner, the attaching elements simultaneously serve as adjusting elements for adjusting the holding element and moreover for the at least partial non-positive coupling of the holding element via the head part in the free space configured as recesses in the fitting elements. Accordingly, the attaching elements of the attaching mechanism fulfill three functions, namely producing the non-positive and/or positive connection between the holding element and the connecting element, the at least partial coupling of the holding element via the head part to the free space configured as the recesses in the fitting elements, and the function of adjusting elements for adjusting the holding element about the center of rotation and/or the axis. Accordingly, the alignment of the corner fitting is realized by loosening the attaching elements, whereby the attaching mechanism is brought into the released condition. After loosening the adjusting elements, the holding element can be rotated in a range of at least −2 degrees to +2 degrees, respectively placed at a slant and can be adjusted in said position by tightening the adjusting elements. Obviously, a rotation of, respectively placing the holding element at a slant can be realized by means of differently tightening and/or loosening the attaching elements. However, at least by tightening the attaching elements, i.e. by transferring the attaching mechanism from the released condition into the fixing condition, it is achieved that, in the previously adjusted slanted position, the holding element is at least non-positively, at least coupled to the fitting elements preferably in the free space configured as recesses.

Advantageously, the connecting element and the holding element are configured as a common, monolithic and/or integral structural component. In this case, for example a structural component manufactured in an injection molding process from one or more different components is understood as a monolithic structural component. A structural component manufactured from a material, which for example is carved out from the material by machining a material, for example a metal block, can be understood as an integral structural component. Preferably, a common structural component is also understood in that the holding element and the connecting element are configured as individual parts, which are provided as a common structural component in a pre-mounted condition.

The integral construction type of the holding element with the connecting element offers the advantage that attaching elements, which serve for connecting the holding element to the connecting element, can be foregone. With the integral construction type of the holding element with the connecting element, obviously, based on the missing attaching elements between the connecting element and the holding element, the immobilization, i.e. the positive coupling between the holding element and the fitting elements and the adjustment of the holding element about the center of rotation and/or the axis can be realized just by means of additional attaching and/or adjusting elements, such as for example screws, pins, wedges or possibly also latching means, which allow for coupling the holding element to the fitting elements and for aligning the holding element in relation to the fitting elements.

In the present application the following terms are understood as follows, however should not be understood as being limited thereto:

A structural component, which is movable essentially parallel to the fitting elements, i.e. displaceable and advantageously also rotatable, is understood as the "holding element" and which in particular serves for displacing the connecting element, which is operatively connected to the holding element, parallel to the fitting elements and for aligning it with a door element restrained in a restraining area about a center of rotation and/or an axis. In this case, the holding element may be configured as a single-surface or multi-surface body. Obviously, the holding element may as well be configured of one or more struts connected to each other or otherwise, such as of an angled part. The free space available between the fitting elements and formed by the distance of the fitting elements to each other is the only limiting factor for the type and construction form of the holding element.

A structural component accommodating the center of rotation and/or the axis is understood as the "connecting element". For increasing the variability of the connecting element, said reception may have different sizes, respectively may be adaptable to receptions having different sizes, for example by means of adapter inserts. The connecting element may thus be a separate structural component, which is in operative connection with the holding element via attaching elements, or it may as well be embodied with the holding element as a common monolithic and/or integral structural component.

In case the connecting element is connected to the holding element via attaching elements, advantageously, the attaching elements should fulfill also the function of the adjusting elements. Obviously, the adjusting elements may be configured at the corner fitting in addition to the attaching elements.

The "infinitely variable selection of centers of rotation" is understood to range between approximately 45 mm and 80 mm. Obviously, if required, the inventive corner fitting may be configured to allow for selecting centers of rotation outside the above-described range. However, this would require having to cut out the door element in a larger than usual area and the corner fitting would have to be dimensioned correspondingly to allow for expanding the displaceability of the holding element between the fitting elements.

Advantageously, the "rotatability of the holding element about the center of rotation and/or the axis" is realized clockwise and counter-clockwise. In this case, a rotation in a range of −2 degree to +2 degrees is preferred. In an even more preferred way, the holding element is rotatable in a range of −1.5 degrees to +1.5 degrees.

A free space configured in the shape of grooves, small channels, furrows, shoulders, rails, protrusions, slots and/or for example roller belts, which allows for a displaceable, i.e. mobile support of the holding element, may be understood as the "free space, which is configured as a recess in at least one fitting element". Obviously, latching means may be configured along the free space, which allow for the holding element to latch in and thus for a pre-adjustment of the door element to given dimensions of centers of rotation and/or dimensions of axes. However, it might be that just latching and/or stop points are configured for standardized centers of rotation and/or the axes. Advantageously, in this case, an infinitely variable displaceability of the holding element in the free space is guaranteed between two latching means, respectively between two latching and/or stop points, whereby a fine-tuning of the corner fitting is possible to non-standardized centers of rotation.

An inventive method for disposing a door element on a center of rotation and/or an axis via a corner fitting, in particular the inventive corner fitting, includes a first fitting element and a second fitting element, which each include at least sectionwise a locating portion for the abutment against the door element and are interconnected while restraining the door element, provides essentially according to the disclosure that a holding element, which is at least partially rotatable about the center of rotation and/or the axis and displaceable in relation to the fitting elements, is disposed in the restraining area of the door element between the fitting elements, and which is in operative connection with a connecting element, which serves for supporting the door element on the center of rotation and/or the axis.

With the intention to avoid repeating the advantages of the inventive method, it is referred to the description of the advantageous embodiment of the inventive corner fitting and it is fully and comprehensively referred to the latter.

Hereinafter, further measures enhancing the disclosure will be illustrated in the following in detail in conjunction with the description of an exemplary embodiment of the disclosure based on the Figures.

DETAILED DESCRIPTION OF THE DRAWINGS

Figure 1:
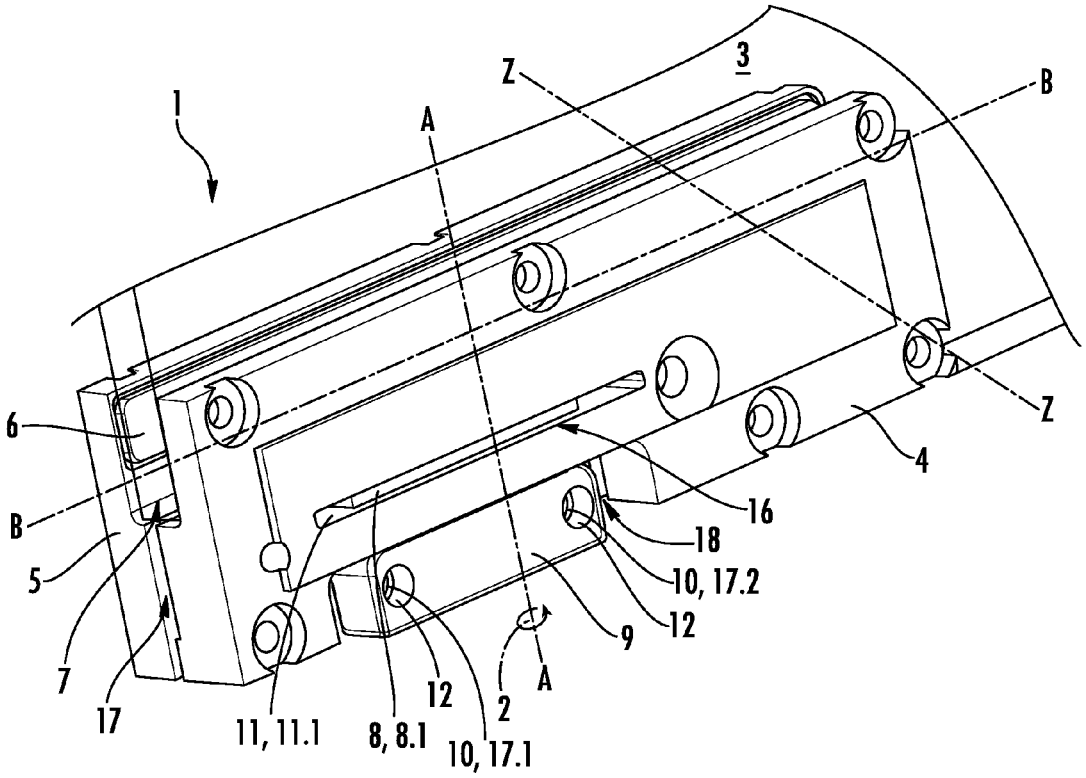
FIG. 1 shows an inventive corner fitting, which is clamped to the left lower corner of a door element, in a perspective side view.

Throughout the different Figures, same parts are always identified by the same reference numerals, and therefore they will be normally only described once.

FIG. 1 shows a door element 3, which, via a corner fitting 1, is supported on a center of rotation 2, which may be for example a BTS-axis as well. At the lower left corner of the door element 3, the corner fitting 1 is clamped to the door element 3 via locating portions 6. The corner fitting 1 illustrated in FIG. 1 is configured such as to be able to be clampable to the top left or the top right or the lower right corner of the door element 3 for supporting the door element 3 on a center of rotation 2 and/or an axis. The corner fitting 1 comprises a first fitting element 4 and of a second fitting element 5. Both fitting elements 4 and 5 include locating portions 6, which serve at least for indirect abutment via an intermediate layer, not illustrated here, against the door element 3. A restraining area 7, into which the door element 3 is insertable, is formed between the fitting elements 4 and 5. A holding element 8, which is displaceable in relation to the fitting elements 4 and 5 in particular in longitudinal extension of the fitting elements 4 and 5, is disposed between the two fitting elements 4 and 5. A connecting element 9, which is operatively connected to the holding element 8, serves for supporting the door element 3 on the center of rotation 2 and/or the axis. In the present case, the connecting element 9 is non-positively and/or positively operatively connected to the holding element 8 via two attaching elements 10. The holding element 8 being in operative connection with the connecting element 9 is guided to be movable in the fitting element 4 and the fitting element 5 in a free space 11 configured as a recess 11.1 in the shape of a groove. In this case, the free space 11 is configured in the shape of a groove parallel to the longitudinal extension of the fitting elements 4 and 5. The holding element 8 and the connecting element 9, which is in operative connection via the attaching elements 10, are thereby displaceable parallel along the recess 11.1, i.e. with regard to, respectively in the longitudinal extension of the attaching elements 10. As the connecting element 9 with the holding element 8 is displaceable in relation to the door element 3 in the opposite direction, the door element 3 can be infinitely variably aligned on the center of rotation 2 along the axis BB, for example in its position in a door frame or a glass door installation. In the event e.g. the center of rotation 2, respectively the axis of rotation of the door element 3, represented by the axis AA, is located outside the ranges determined for the usual centers of rotation 2, namely outside of 55 mm, 65 mm or 70 mm, the door element 3 may be adjusted on the center of rotation and/or the axis by displacing the holding element 8 and thereby with the connecting element 9, which is operatively connected to the holding element 8. In the present case, the holding element 8 and the connecting element 9 are configured as two interconnected structural components comprising the attaching mechanism, which is incorporated into the present structural components, namely the holding element 8 and the connecting element 9. For transferring the attaching mechanism form the released condition, in which the holding element 8 is supported to be movable in the longitudinal extension of the fitting elements 4 and 5, into the fixing condition, the attaching elements 10, which connect the holding element 8 via the connecting part 8.2 to the connecting element 9, are screwed into the through-holes 12. When screwing the attaching elements 10 into the connecting part 8.2 of the holding element 8, the head part 8.1 of the holding element 8 gets clamped at the fitting elements 4, 5 via a resting portion 16 at least sectionwise at least non-positively in the free space 11, configured as a recess 11.1 in the form of a groove. Thus, in the fixing condition of the attaching mechanism, the displaceability of the holding element 8 and of the connecting element 9 operatively connected to the holding element 8 is disabled, respectively the holding element 8 is immobilized in its position at the fitting elements 4 and 5.

Moreover, the head part 8.1 and in particular the resting portion 16 of the head part 8.1 serves for holding the holding element 8 in the free space 11 configured as a recess 11.1 even if the holding element 8 is adjusted from its parallel alignment to the fitting elements 4 and 5 into a slanted arrangement in relation to the fitting elements 4 and 5, respectively rotated about the center of rotation 2 and/or the axis. The attaching elements 10, which simultaneously fulfill the function of adjusting elements 17.1 and 17.2, serve for adjusting the holding element 8 about the center of rotation 2 and/or the axis. As can be seen in FIG. 1, the front adjusting element 17.1 and the back adjusting element 17.2 are tightened, wherein the holding element 8 is movable almost parallel to the axis ZZ in the direction or the front or in the direction of the back fitting elements 4 and 5 in a free space 17 formed as a distance between the fitting elements 4, 5 in a second direction of movement. In case the holding element 8 is tightened in the direction of the front fitting element 4, the distance between the connecting element 8.2 to the fitting element 4 is reduced, respectively the distance between the connecting element 8.2 to the fitting element 5 is increased. The corner fitting 1 and the door element 3 connected thereto are thereby displaced here in the view of FIG. 1 to the front along the axis ZZ. For displacing the holding element 8 in relation to the fitting elements 4 and 5, preferably the adjusting elements 17.1 and 17.2 are loosened, whereby the holding element 8, which is supported between the fitting elements 4 and 5 to be movable, and moreover also the connecting element 9, which is operatively connected to the holding element 8, can be positioned, i.e. are displaceable for adjusting on the center of rotation 2 and/or for compensating for a plane offset, respectively for correcting the angle. After positioning the holding element 8 with the connecting element 9, they are adjusted in their position by tightening the adjusting elements 17.1 and 17.2, namely by a non-positive and/or positive coupling of the holding element 8 via the resting portion 16 configured at the head part 8.1 at the free space 11 configured as a recess 11.1 of the fitting elements 4 and 5. By rotating the holding element 8, as indicated by way of example clockwise, the back portion of the connecting element 8.2 of the holding element 8 reaches abutment at the fitting element 4 and the front portion of the connecting element 8.2 of the holding element 8 reaches abutment at the fitting element 5, wherein the door element 3 accommodated between the fitting elements 4 and 5 in the restraining area 7 is rotated in relation to the rotation of the holding element 8.

With the intention to assist the movement of the holding element 8 in longitudinal extension of the fitting elements 4 and 5, which holding element is connected to the connecting element 9 via the connecting part 8.2, a lower recess 18 is configured at the fitting elements 4 and 5, which is preferably configured parallel to the recess 11.1 formed as the free space 11 and preferably extends over the same length as the recess 11.1 configured as the free space 11. In this case, the lower recess 18 is preferably configured in both fitting elements 4 and 5 and extends over the distance 17 of the fitting elements from the one to the other fitting element 4 and 5.

Figure 2:
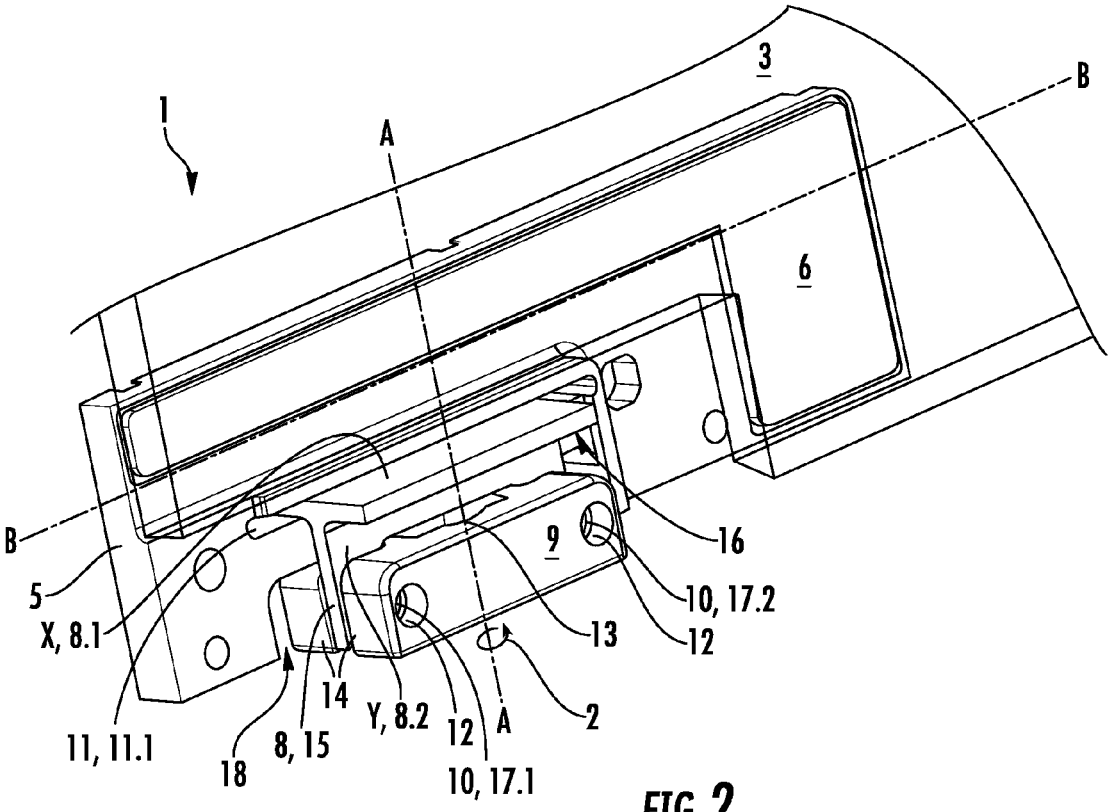
FIG. 2 shows the corner fitting of FIG. 1, wherein, for illustrating the support of the holding element, the front fitting element is not illustrated, FIG. 3*a* and *b:* a door element, for which the position in relation to a door casing, respectively to sidepanels is adjustable via two inventive corner fittings.

For a better illustration of the support of the holding element 8 in the corner fitting 1, FIG. 2 shows the corner fitting 1 without the front fitting element 4. As can be seen, outside the locating portion 6, the door element 3 includes a cutout according to conventional glass cutout standards and, outside the cutout, abuts against the locating portions 6 of the fitting elements 4 and 5. A free space 11, which serves for disposing the holding element 8 and the connecting element 9, is created in the corner fitting 1 in the area of the cutout of the door element 3. As can be additionally seen in FIG. 2, the attaching mechanism just comprises the holding element 8 and the connecting element 9, which are interconnected via two attaching elements 10, which can be manipulated through the through-holes 12 configured at the connecting element 9. Tightening the attaching elements 10 causes in this case that the holding element 8, at least non-positively engages in the free space 11 of the fitting element 5, configured as a recess 11.1 in the shape of a groove. In the fixing condition of the attaching mechanism, just a small part of the surface of the head part 8.1 of the holding element 8 rests on a surface of the free space 11 configured as a recess 11.1.

In the present case, the holding element 8 is configured as a T-profile and comprises two surfaces X and Y, which are essentially orthogonally to each other. The surface X comprises the head part 8.1 with the surfaces, which serve for guiding the holding element 8 on both sides in the free space 11 configured as a recess 11.1 of the fitting elements 4 and 5. As can be seen, the surfaces X are dimensioned such that they allow for an at least partial rotation of the holding element 8 and thereby continue to retain, respectively to guide the head part 8.1 of the holding element 8 in its slanted position on both sides in the free space 11 configured as a recess 11.1 in the fitting elements 4 and 5.

The connecting part 8.2 with the surface Y connects to the surface X, i.e. to the head part 8.1 of the holding element 8, which part is connected to the connecting element 9 via two attaching elements 10, which pass through through-openings 12, for example in the shape of bores with internal threads. For connecting the holding element 8, via the connecting part 8.2, to the connecting element 9, apertures 14 are configured at the connecting element 9, in which the holding element 8 engages via tappets 15 configured at the connecting part 8.2. In the present case, the attaching elements 10 also serve as adjusting elements 17.1 and 17.2.

The connecting element 9 comprises a reception 13, which serves for supporting, respectively for disposing the door element 3 on a center of rotation 2 and/or an axis. When adjusting the holding element 8 via the attaching elements and/or adjusting elements 10, 17.1 and 10, 17.2, advantageously, in the free space formed as a distance 17 between the fitting elements 4, and 5, the connecting part 8.2 is vertically displaced with the surface Y to the displacement of the holding element 8 in longitudinal extension of the fitting elements 4 and 5 in a second direction of movement. Advantageously, said adjustability of the corner fitting 1 in the second direction of movement serves for adjusting the plane offset.

Figure 3A:
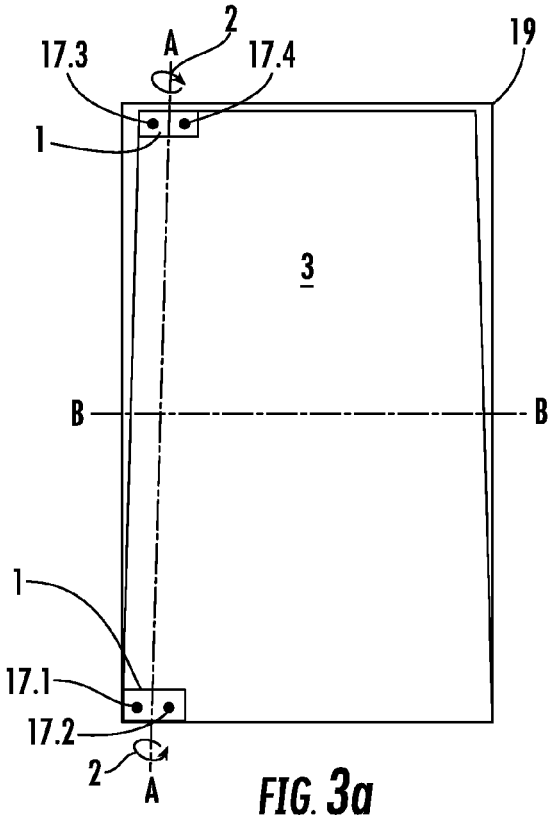
Figure 3B:
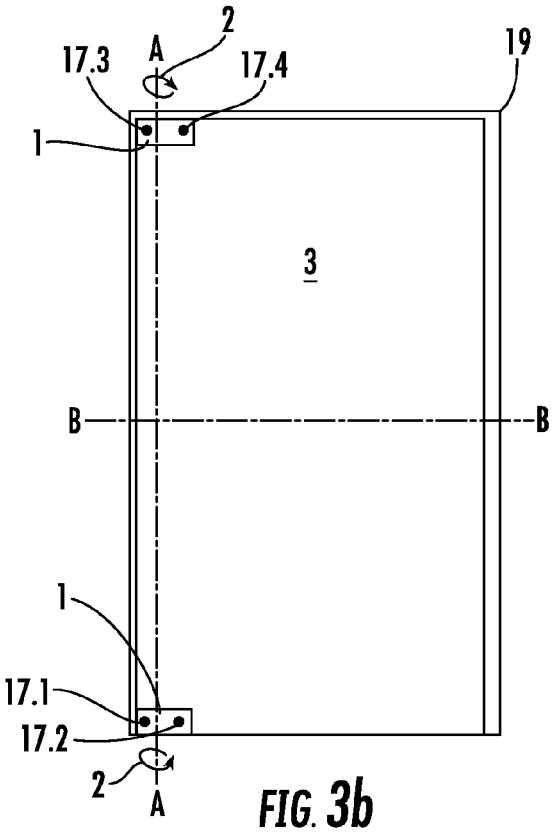

FIGS. 3*a* and 3*b* show by way of example the adjustment of a door element 3 via an inventive corner fitting 1 at a door casing 19 (in the present case, to sidepanels or to a sidepanel with overpanel, which sidepanel surrounds the door element 3). In FIG. 3*a* the door element 3 is already disposed, respectively adjusted on the center of rotation 2 and/or the axis AA, by previous displacement, respectively adjustment parallel to the axis BB, i.e. by displacement of the holding element 8 in the first direction of movement in longitudinal extension of the fitting elements 4 and 5.

However, as can be seen, the door element 3 is tilted about the axis BB, in the present case, the top right corner of the door element 3 is tilted from the plane of the drawing to the back, respectively the lower right corner protrudes to the front from the plane of the drawing. Accordingly, the door element 3 does not finish flush with the long side of the door casing 19. For aligning the door element 3 with the door casing 19, i.e. pull the top right corner of the door element 3 to the front, respectively to move the lower right corner of the door element 3 to the back, the holding element 8 of the upper corner fitting 1, after previous loosening of the adjusting elements 17.3. and 17.4, is rotated clockwise about the axis AA, and then the adjusting elements 17.3 and 17.4 are tightened again. For this purpose, after previous loosening of adjusting elements 17.1 and 17.2, the holding element 8 of the lower corner fitting 1 is rotated in the opposite direction counter-clockwise about the axis AA. When rotating the holding element 8 clockwise, the holding element 8 reaches thereby abutment against the front fitting element in the right area of the upper corner fitting 1, respectively reaches abutment against the back fitting element in the left area of the upper corner fitting. Obviously, the adjustment of the corner fittings 1 may be realized as well by tightening one of the adjusting elements 17.1, 17.2, 17.3 and/or 17.4 in the direction of the advance of the adjusting elements 17.1, 17.2, 17.3 or 17.4, namely by a joint movement of the holding element 8 with the advance of one of the fitting elements 17.1, 17.2, 17.3 and/or 17.4.

Thus, by means of the counter-rotation of the holding element 8 of the upper and of the lower corner fittings 1, it is possible with the inventive corner fitting 1 to align the door element 3 at the door casing 19, refer to FIG. 3*b*.

Figure 4:
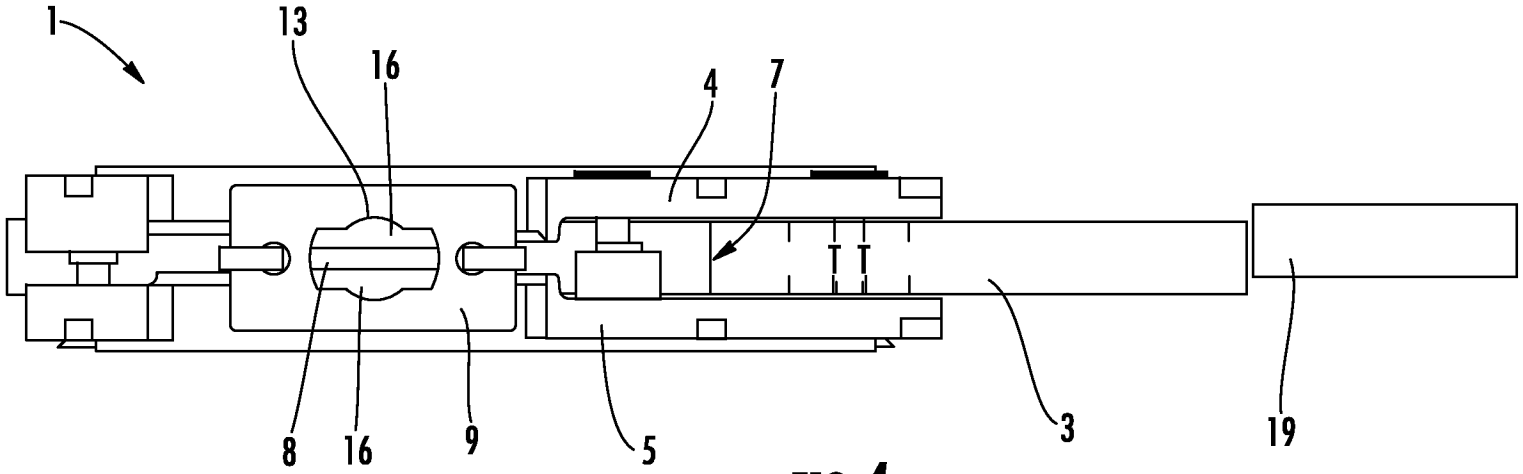
FIG. 4 is a top view of the corner fitting of FIG. 1 in the delivery condition with the holding element aligned to a central BTS-axis, wherein the door element clamped by means of the corner fitting is disposed offset in the plane with regard to a sidepanel, and FIG. 5 the corner fitting of FIG. 4 after adjusting the corner fitting and aligning the plane of the door element on the plane of the sidepanel via the adjustable holding element.
Figure 5:
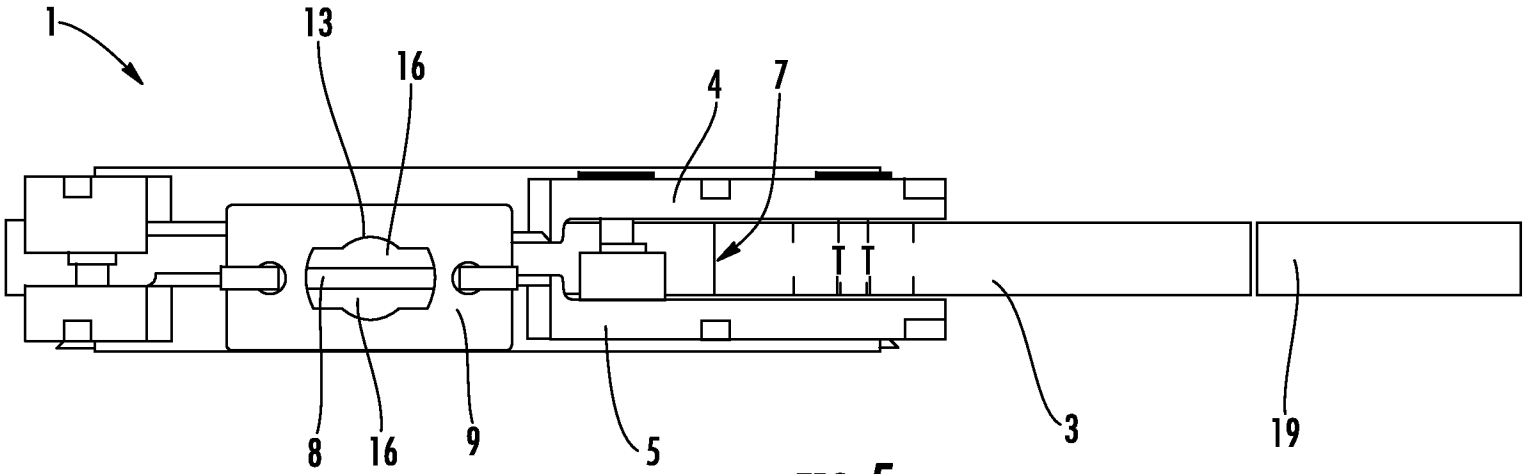

FIGS. 4 and 5 show the corner fitting 1 of FIG. 1 in a top view from below, i.e. along the axis AA illustrated in FIG. 1. In FIG. 4, the corner fitting 1 in a delivery state is pre-adjusted on center for the reception of a BTS-rotating axis. However, as illustrated in the Figures, the axis of rotation, respectively the center of rotation 2 is offset to the sidepanel 19, there is a plane offset between the door element 3, which is restrained in the corner fitting 1, and the sidepanel 19. In FIG. 4, the plane offset is illustrated by means of a step formed between the door element 3 and the sidepanel 19. With the intention of compensate for the plane offset between the door element 3 and the sidepanel 19, the door element 3 needs to be aligned flush with the sidepanel 19. The adjusting elements 17.1 and 17.2 need to be loosened for this purpose to adjust the holding element 8, which is supported between the fitting elements 4 and 5, and the connecting element 9, which is connected to the holding element 8, to the axis of rotation, respectively the center of rotation 2.

After loosening the adjusting elements 17.1 and 17.2, i.e. after transferring the attaching mechanism into the released condition, via the movable supported holding element 8, the connecting element 9 can be displaced vertically to the axis AA illustrated in FIG. 1 and in relation to the fitting elements 4 and 5 along the axis ZZ illustrated in FIG. 1. In comparison to FIG. 4, the restraining area 7 of the corner fitting 1 with the door element 3 restrained therein in FIG. 5, is displaced to the top, while maintaining the positioning of the corner fitting 1, on the axis of rotation, respectively the center of rotation 2, via the connecting element 9.

After displacing the door element 3, i.e. after adjusting the plane of the door element 3 to the plane of the sidepanel 19, the adjusting elements 17.1 and 17.2 are tightened, i.e. the attaching mechanism is transferred from the released condition into the fixing condition, whereby the holding element 8 and the connecting element 9 connected to the holding element 8 are at least non-positively and if necessary positively connected to the fitting elements 4 and 5 by clamping the surface of the head part 8.1 of the holding element 8 with the surface of the fitting elements 4 and 5 formed in the free space 11. In this regard, in addition to the alignment on the dimension of the axis of rotation, the inventive corner fitting 1 allows for aligning a door element 3 clamped in the corner fitting 1 to a plane formed by a sidepanel, a casing 19 and/or a center joint.

The invention claimed is:

1. A corner fitting for a door element to be disposed on a center of rotation or an axis, including a first fitting element and a second fitting element, which, at least sectionwise, each include a locating portion for the abutment against the door element and are interconnectable while restraining the door element, wherein a restraining area forms between the first and second fitting elements, into which the door element is insertable, and the first and second fitting elements are formed such that a holding element is disposed between the first and second fitting elements, which is displaceable in relation to the first and second fitting elements and is at least partially rotatable about the center of rotation or the axis, wherein the holding element is in operative connection with a connecting element, which serves for supporting the door element on the center of rotation or the axis.

2. The corner fitting according to claim 1, wherein the holding element is infinitely variably movable along a longitudinal extension of the first and second fitting elements, along a first direction of movement.

3. The corner fitting according to claim 2, wherein the holding element is latchable along the longitudinal extension of the first and second fitting elements, wherein a variable movement of the holding element can be performed between two latching points or the first and second fitting elements include latching means.

4. The corner fitting according claim 1, wherein the first and second fitting elements include a free space as a guide, in which the holding element is movable.

5. The corner fitting according to claim 1, wherein the free space is formed to the holding element such that the holding element is movable orthogonally a the first direction of movement in a second direction of movement.

6. The corner fitting according to claim 1, wherein the free space is formed in such a manner with regard to the holding element that a rotation of the holding element in relation to the first and second fitting elements about the center of rotation or the axis is approximately −2 degrees to approximately +2 degrees.

7. The corner fitting according to claim 1, wherein the restraining area is formed such that a thickness of the door element of up to approximately 22 mm can be accommodated, wherein the first and second fitting elements, the holding element as well as the connecting element are adapted to each other such that a movement of the holding element up to approximately 15 mm in relation to the first and second fitting elements can be performed in the second direction of movement.

8. The corner fitting according to claim 1, wherein the free space or the first and second fitting elements are formed in such a manner with regard to the holding element that the holding element can be moved along a longitudinal extension of the fitting element up to 35 mm.

9. The corner fitting according to claim 1,
wherein
an attaching mechanism is incorporated at the holding element as well as at the connecting element, which mechanism is transferable between a released condition and a fixing condition, wherein, in the released condition, the holding element is displaceable at the first and second fitting elements, and in the fixing condition, the holding element is non-positively or positively connected to at least one of the first and second fitting elements.

10. The corner fitting according to claim 1,
wherein
the holding element s non-positively or positively connected to the fitting element via at least one attaching element, wherein an alignment of the connecting element on the center of rotation or the axis is realized by loosening the non-positive or positive connection between the holding element and the fitting element.

11. The corner fitting according to claim 1,
wherein
the free space includes a recess in at least one of the first and second fitting elements, wherein the recess extends along a longitudinal extension of the fitting element, and the holding element with a head part is supported to be movable in the recess, wherein the head part acts in a clamping manner in the recess in the fixing condition.

12. The corner fitting according to claim 1,
wherein
the holding element includes a connecting part, to which the connecting element is attached, wherein a head part and the connecting part form a monolithic or integral structural component.

13. The corner fitting according to claim 12,
wherein
the connecting part extends through a distance between the first and second fitting elements, the distance being larger than the material thickness of the connecting part.

14. The corner fitting according to claim 1,
wherein
the first and second fitting elements are embodied with a lower recess, in which the connecting element is displaceable.

15. The corner fitting according to claim 1,
wherein
a rotation of the holding element is realized about the center of rotation or the axis via at least two adjusting elements.

16. A method for disposing a door element on a center of rotation or an axis via a corner fitting, the method including the following steps:
providing a first fitting element and a second fitting element, each having at least sectionwise a locating portion for abutting against the door element, and being interconnected while restraining the door element,
disposing a holding element in the restraining area of the door element between the first and second fitting elements, rotating, at least partially, the holding element about the center of rotation or the axis,
displacing the holding element in relation to the first and second fitting elements, the holding element being in operative connection with a connecting element, and
supporting the door element on the center of rotation or the axis.

* * * * *